US007678022B1

(12) United States Patent
Hsieh

(10) Patent No.: US 7,678,022 B1
(45) Date of Patent: Mar. 16, 2010

(54) LOADING DEVICE OF LEG EXTENSION MACHINE

(75) Inventor: Li-Min Hsieh, YangMei Township, Taoyuan County (TW)

(73) Assignee: Chi Hua Fitness Co., Ltd., Taoyuan County (TW)

( * ) Notice: Subject to any disclaimer, the term of this patent is extended or adjusted under 35 U.S.C. 154(b) by 0 days.

(21) Appl. No.: 12/385,678

(22) Filed: Apr. 16, 2009

(51) Int. Cl.
*A63B 21/005* (2006.01)

(52) U.S. Cl. ..... 482/5; 482/1; 482/6

(58) Field of Classification Search ..... 482/1–9, 482/51, 57, 69, 70, 79, 92, 125, 900–902; 434/247

See application file for complete search history.

(56) References Cited

U.S. PATENT DOCUMENTS 6,375,598 B1 * 4/2002 Frame et al. ..... 482/8
2005/0239600 A1 * 10/2005 Liang et al. ..... 482/1
2006/0003872 A1 * 1/2006 Chiles et al. ..... 482/57
2008/0248926 A1 * 10/2008 Cole et al. ..... 482/5

* cited by examiner

*Primary Examiner*—Glenn Richman
(74) *Attorney, Agent, or Firm*—Rosenberg, Klein & Lee

(57) ABSTRACT

A loading device of a leg extension machine includes: a set of symmetric left and right gear disks linked and engaged with each other and installed onto two axles of left and right leg extension elements respectively, such that if the leg extension elements are pulled apart or pressed together, the two axles drive the left and right gear disks to rotate in opposite directions synchronously; a motor having a first gear installed on a main shaft and engaged with one of the left and right gear disks and a second gear engaged between the first gear and the gear disks for producing a driving resistance to the left and right gear disks synchronously; a current controller, provided for an exerciser to adjust the current transmitted to the motor through a microcomputer control panel; and a movement path sensor, for using pulse signals generated by a pair of optical couplers as feedback positions and determining the positive or negative rotation if the axle drives the optical interrupt disk, so as to control a curved load, and appropriately compensate the load current to provide a smooth and real-world setting.

6 Claims, 12 Drawing Sheets

LOADING DEVICE OF LEG EXTENSION MACHINE

BACKGROUND OF THE INVENTION

1. Field of the Invention

The present invention relates to a loading device of a leg extension machine, in particular to a loading device using the linear proportion between current and torque of a DC or brushless motor and a pair of gear disks as resistance components to improve traditional exercise loads.

2. Description of the Related Art

Various different types of fitness equipments are designed according to different fitness exercises. For instance, a treadmill machine is designed specially for jogging or running, and a leg extension machine is designed specially for training abductor and adductor (inner and outer thigh muscles) and leg and foot muscles, and these machines were disclosed in U.S. Pat. Nos. 7,396,319, 5,575,744 and 4,478,411.

In addition to leg extension components, the main structure of a conventional leg extension fitness machine further includes a resistance device as disclosed in U.S. Pat. No. 7,396,319 and shown in FIGS. 1 and 2 for providing an exercise load. The fitness machines of this sort include extension elements 12 installed at the front of a seat 11 and provided for exercising a thigh 121 and a calf 122, a movement and internal or external direction switching component 13 installed at the bottom of the fitness machine, a resistance arrangement 14 disposed at a lateral side of the fitness machine and linked with the movement and internal or external direction switching component 13 by a cable 15 to provide a load. When the exerciser's thigh and calf drive the extension element 12 to move inward or outward to link the movement switching component 13, the resistance component 14 still provides an exercise load to the exerciser.

However, most conventional exercise loads are resistance components 14 composed of a plurality of weight stacks 141, but such conventional loads still have the following drawbacks:

1. The weight stack 141 comes with a large volume and occupies much space. If an exerciser needs to adjust the exercise load by increasing the number and the weight of the load such as the weight stack 141, it will take much time and effort for the exerciser to make the adjustment, and the exerciser also has to stop the exercise to do so, and thus it is difficult to achieve the expected exercising effect.

2. The load such as the weight stack 141 is heavy and cannot be adjusted easily. Furthermore, a variable load for continuous and smooth exercise cannot be achieved according to a curve, and thus the exercising effect will be lowered, and there is also a potential risk of an exercise-induced muscular injury.

3. If the load such as the weight stack 141 is lifted by a transmission cable 15 and then released slowly, an annoying sound will be produced, and the irritating sound will cause discomfort to the exerciser. Furthermore, the transmission cable 15 is operated together with a winch, and it makes the machine more complicated.

In addition to the aforementioned three drawbacks, the loading device of the conventional leg extension fitness machine 10 still requires a manual mechanism to switch exercises for training the exerciser's inner thigh and outer thigh. Obviously, the prior art requires further improvements.

SUMMARY OF THE INVENTION

It is a primary object of the invention to provide a loading device of a leg extension machine, wherein the torque of a main shaft of a motor is used to replace traditional weight stacks to achieve a light and simple structure, such that the weight, volume, and noise of the machine can be reduced effectively.

Another object of the invention is to provide a loading device of a leg extension machine, wherein the linear relation and the direct proportion between the torque and the current of a DC motor or a brushless motor is used. The larger the current, the larger is the torque of the motor. If the current is reduced, then the torque of the motor will be decreased. The aforementioned principle is used to control the exercise load, so that the leg extension machine can achieve the computerized adjustment and comfortable using effects.

A further object of the invention is to provide a loading device of a leg extension machine, wherein a motor produces a pulling force, a resistance and a vibrating force simultaneously, and users can select from a variety of waveforms, frequencies and amplitudes of a vibration or make adjustments to the vibration, waveform and frequency, as needed. On the other hand, the conventional extension machine does not have these functions.

Still another object of the invention is to provide a loading device of a leg extension machine for monitoring an exerciser's heartbeat rate. If the exerciser's heartbeat rate exceeds a safe range, then the load will be reduced automatically to drop the heartbeat rate gradually to the safe range and assure the exerciser's health.

In order to achieve the above-mentioned objects, the invention includes:

a) two axles of the left and right leg extension elements that include a set of symmetric left and right gear disks linked and engaged with each other, such that when the leg extension elements are spread apart or pressed towards each other, the two axles drive the left and right gear disks to rotate in opposite directions synchronously;

a motor, installed on the base frame, and having a first gear installed onto a main shaft of the motor and engaged with one of the left and right gear disks, for the left and right gear disks to produce a driving resistance synchronously;

a current controller, including a DC power supply, a current and direction switching control unit, a signal processing interface, and a positive and negative rotation signal decoder, such that an exerciser can control the torque of the motor or change the rotating direction of the motor to switch inner thigh and outer thigh exercises and replace a traditional manual mechanism by adjusting a current inputted to the motor from a microcomputer control panel according to a linear relation and a direct proportion between the torque of the motor and the current; and a movement path sensor comprising an optical interrupt disk installed on and linked to the axle, and an optical coupler installed at the periphery of the optical interrupt disk, such that when the axle drives the optical interrupt disk to transmit a pulse signal generated by the optical coupler to the positive and negative rotation signal decoder in the current controller, positive and negative rotation signals are transmitted to the microcomputer control panel for controlling a curved load and compensate a load current appropriately.

BRIEF DESCRIPTION OF THE FIGS.

FIG. 1 is a perspective view of an extension machine as disclosed in U.S. Pat. No. 7,396,319;

FIG. 2 is another perspective view of an extension machine as disclosed in U.S. Pat. No. 7,396,319;

DETAILED DESCRIPTION OF THE PREFERRED EMBODIMENT

Figure 1:
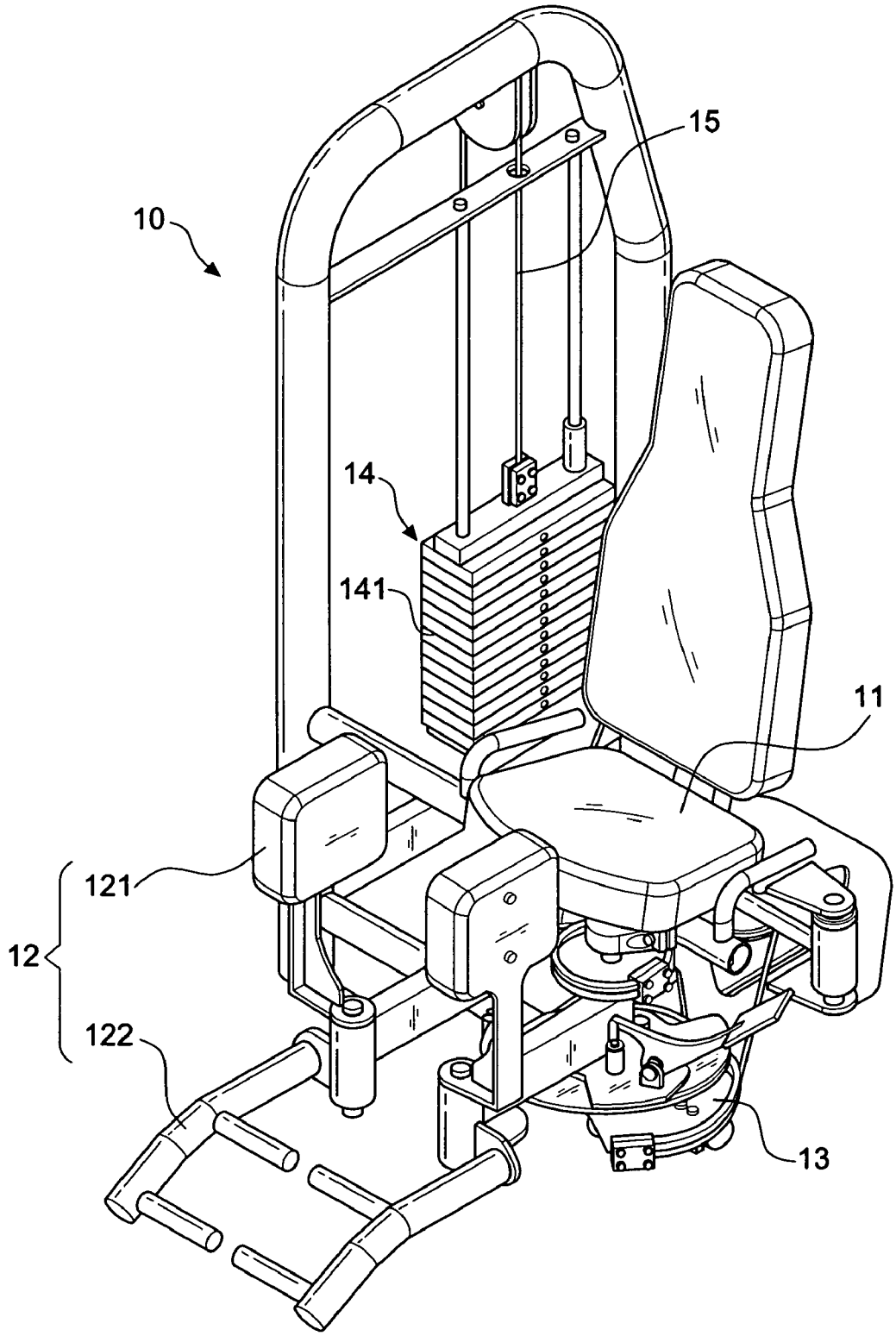
FIG.1 PRIOR ART
Figure 2:
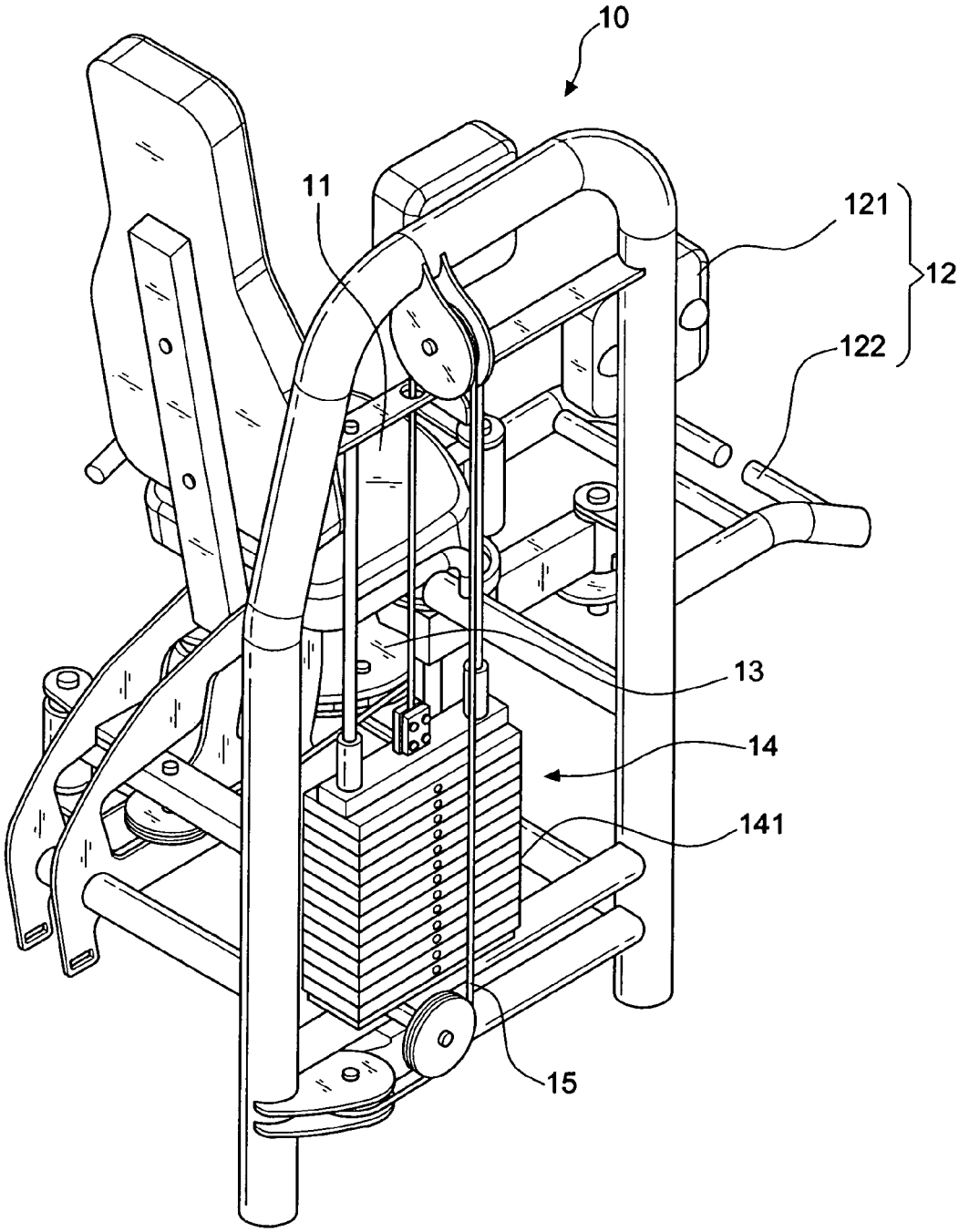
FIG.2 PRIOR ART
Figure 3:
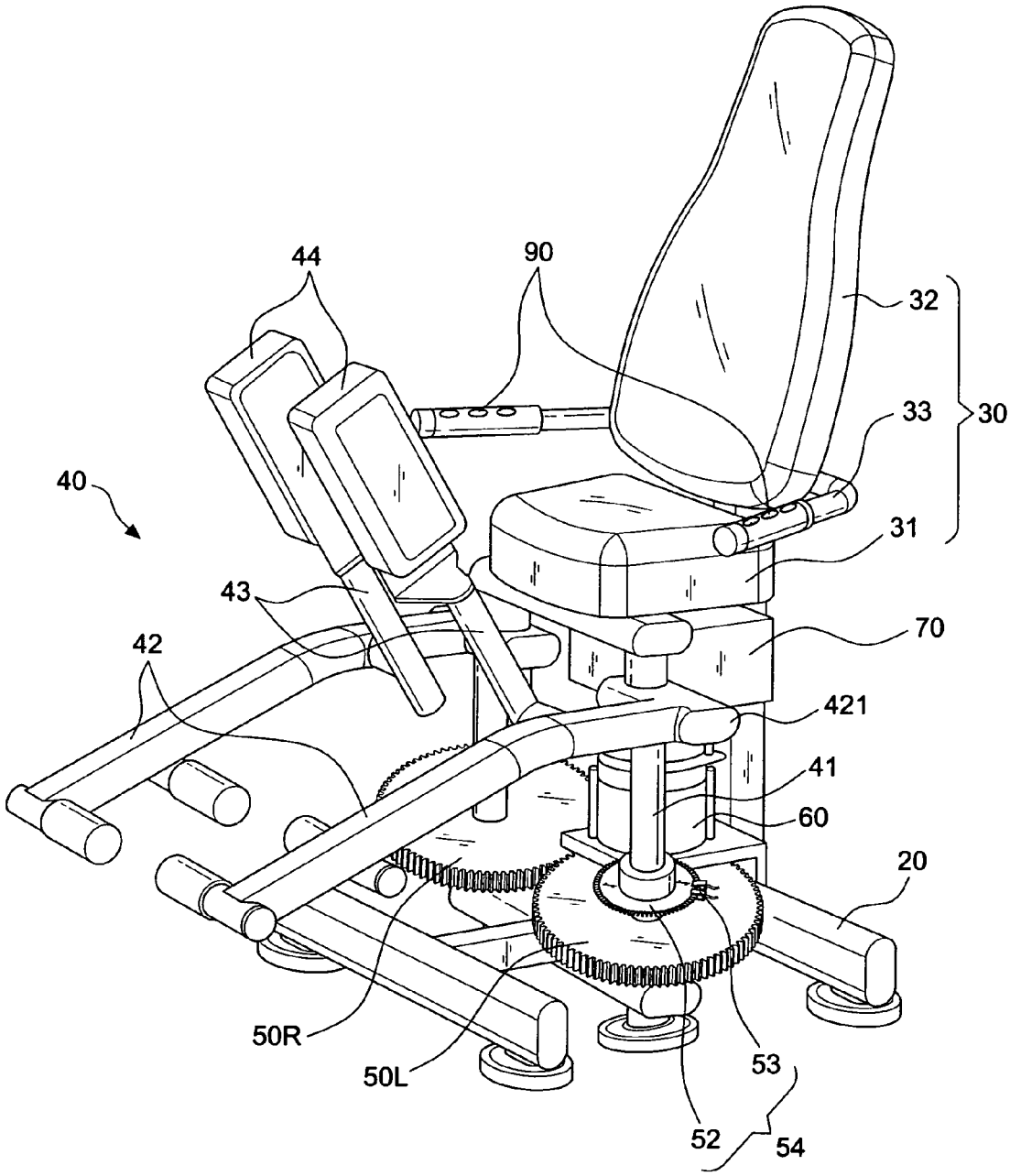
FIG. 3 is a perspective front oblique view of a first preferred embodiment of the present invention.
Figure 4:
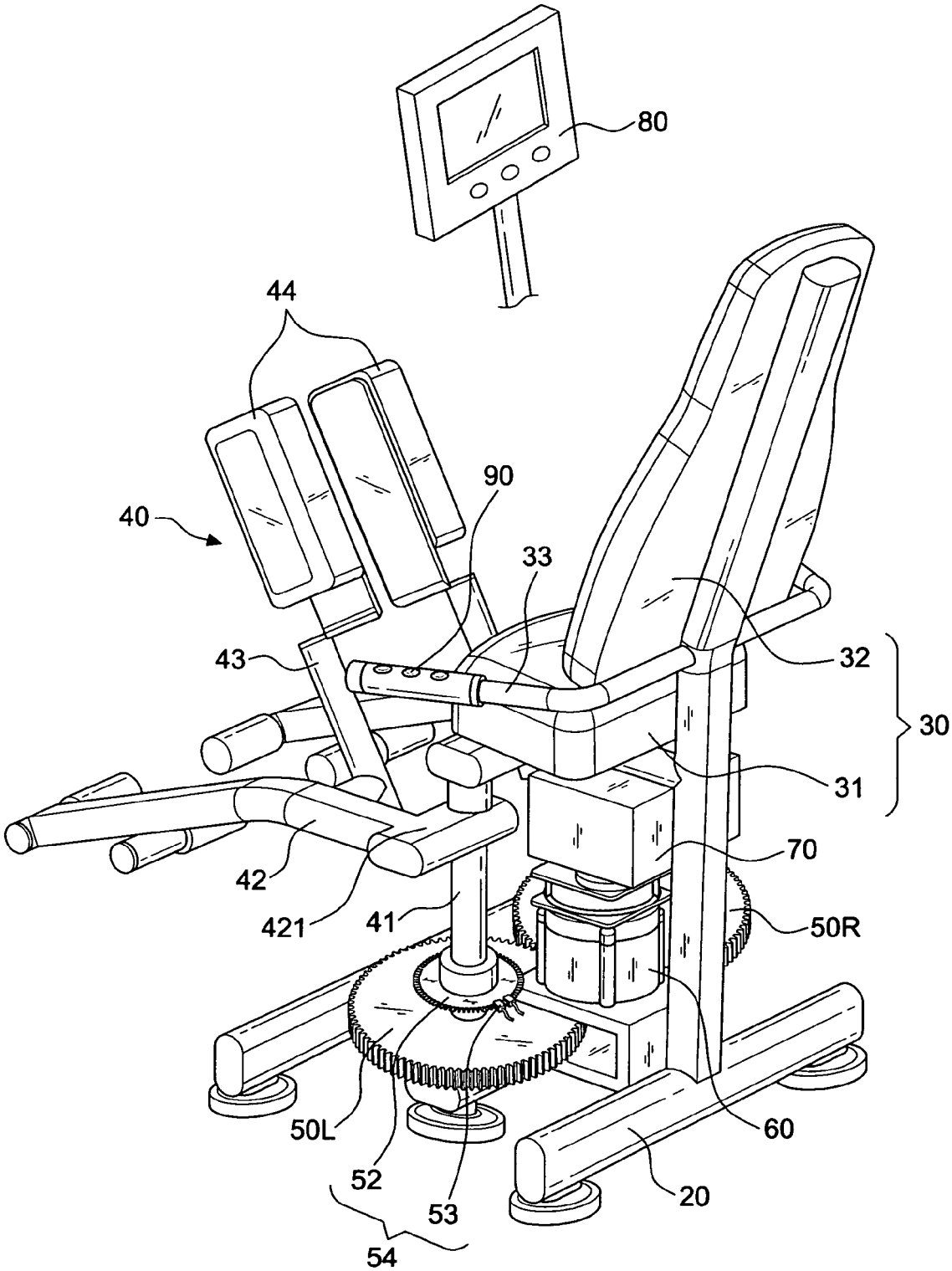
FIG. 4 is a perspective rear oblique view of a first preferred embodiment of the present invention.
Figure 5:
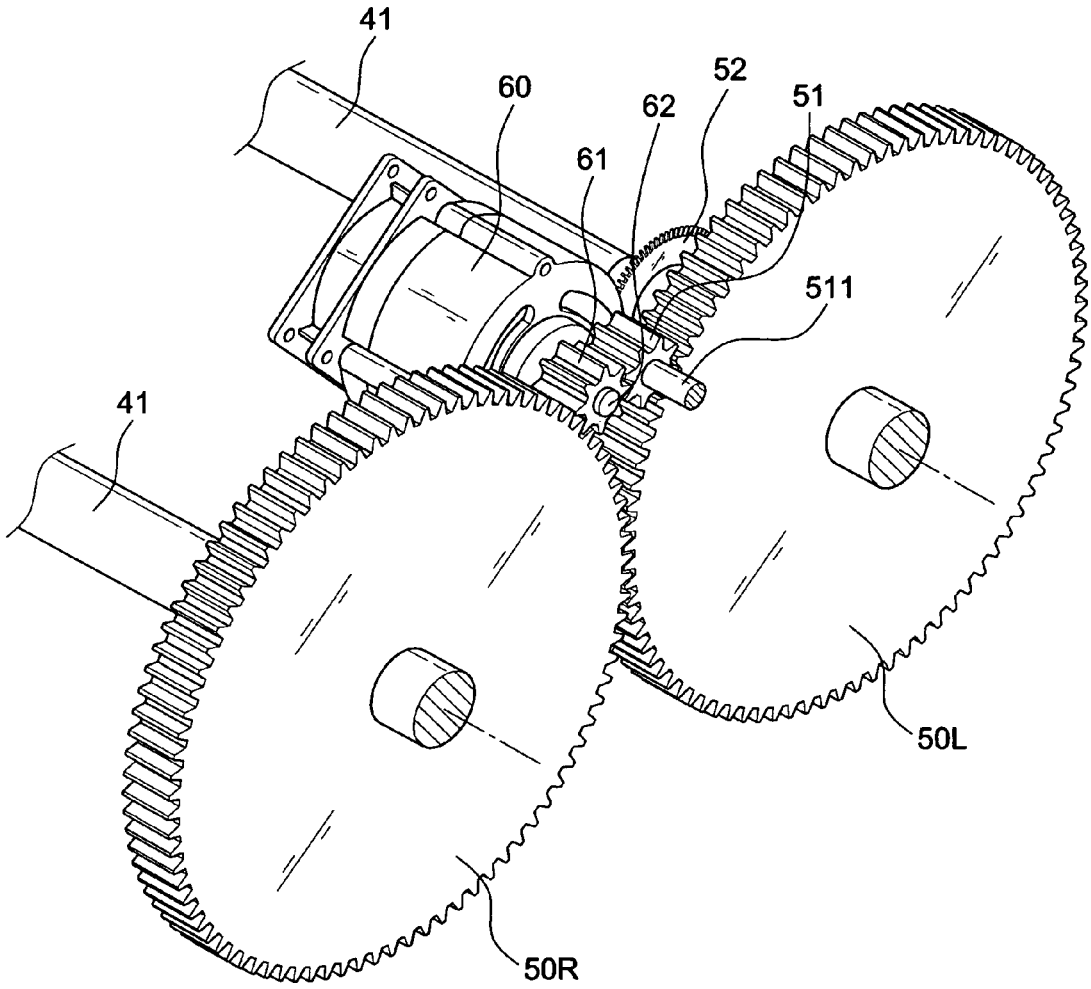
FIG. 5 is a perspective view of a resistance component in accordance with a first preferred embodiment of the present invention.

With reference to FIGS. 3 to 5 for a first preferred embodiment of the present invention, the embodiment comprises:

a base frame 20, made of a plurality of support frames;

a base body 30, disposed on the base frame 20, and having a seat cushion 31, a backrest cushion 32, and left and right handrails 33;

left and right leg extension elements 40, disposed symmetrically at opposite positions between the base frame 20 and the base body 30, and each leg extension element 40 including: an axle 41 pivotally coupled between the base frame 20 and the bottom of the base body 30, and an inner lateral end 421 and the axle 41 fixing and linking a first rod 42 to extend the first rod 42 forward to the length of the exerciser's leg by the axle 41, and a second rod 43, installed at an inner side of the middle section of the first rod 42 and extended from bottom to top, and having a pad 44 installed thereon. However, the aforementioned assembly is a prior art, and thus will not be described in details here.

The present invention is characterized in that the two axles 41 of the left and right leg extension elements 40 have left and right gear disks 50L, 50R installed thereon, and linked and engaged with each other. In other words, the centers of the left and right gear disks are fixed and linked to the two axles 41 respectively, such that if the leg extension elements 40 are pulled apart or pressed towards each other, the axles 41 will drive the left and right gear disks 50L, 50R to rotate in opposite directions synchronously.

Figure 9:
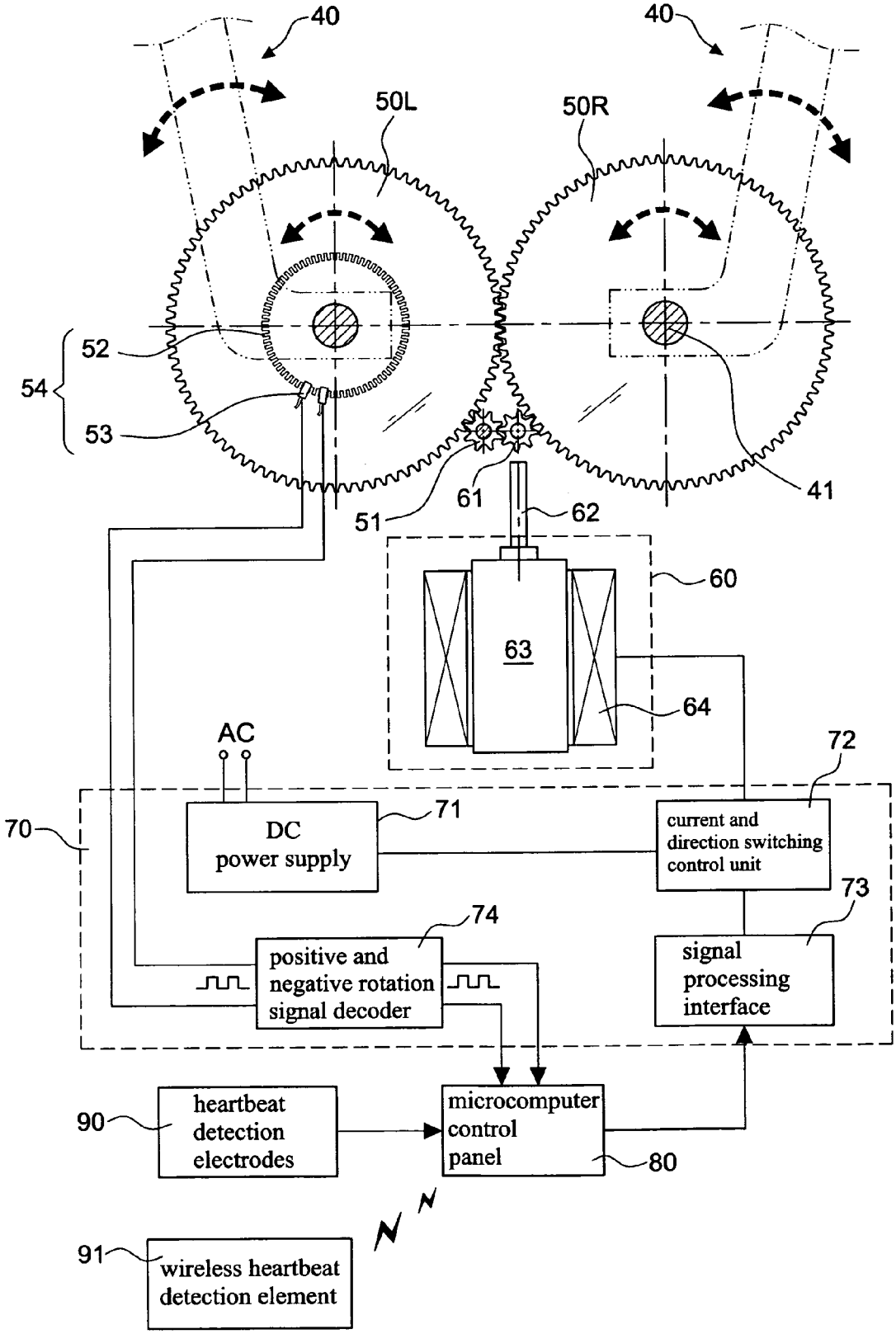
FIG. 9 is a schematic circuit block diagram of the present invention.

In addition, a motor 60 is installed on the base frame 20, and a main shaft 62 of the motor 60 includes a first gear 61 engaged with one of the left and right gear disks 50L, 50R, such that the left and right gear disks 50L, 50R produce a driving resistance synchronously. In this preferred embodiment, the first gear 61 is engaged with the right gear disk 50R, but the invention is not limited to such arrangement only. To balance and reinforce the driving resistance, a preferred embodiment as shown in FIGS. 5 and 9 includes a second gear 51 installed between the first gear 61 and the left gear disk 50L, and pivotally coupled onto a positioning base (not shown in the figures) of the base frame 20 by its axle center 511. In other words, the first and second gears 61, 51 having equal number of teeth are engaged with each other, and also engaged with the corresponding right gear disk 50R and left gear disk 50L respectively, such that the driving resistance produced by the first gear 61 can be uniformly distributed on the left and right gear disks 50L, 50R to constitute a symmetric and balanced exercise resistance to the left and right leg extension elements 40.

A current controller 70 is installed on the base frame 20 and provided for an exerciser to adjust the current inputted to the motor 60 through a microcomputer control panel 80 according to the linear relation and the direct proportion between the torque and the current of the motor 60, so as to control the torque of the motor 60. With reference to FIG. 9 for a preferred embodiment of the present invention, the main shaft 62 of the motor 60 is linked to the center of the rotor 63, and a rotor 64 at the external periphery is composed of a coil for a brushless motor or a magnet for a brushed motor. The larger the current inputted to the current controller 70, the larger is the torque of the main shaft 62, or vice versa. Therefore, when an exerciser's leg drives the leg extension element 40 to be spread apart from or moved towards each other, the first rod 42 will drive left and right gear disks 50L, 50R to move by the axles 41 synchronously. Now, the motor 60 produces a resistance according to a user's setting, and this is a major difference between the present invention and the conventional extension machine, since the invention uses the weight stacks as the resistance components.

The current controller 70 includes a DC power supply 71, a current and direction switching control unit 72, a signal processing interface 73, and a positive and negative rotation signal decoder 74.

The axle 41 of the leg extension element 40 drives an optical interrupt disk 52, and pulses generated by a pair of optical couplers 53 are transmitted to the positive and negative rotation signal decoder 74 for sending positive and negative rotation signals to the microcomputer control panel 80 respectively. On one hand, a display device of the microcomputer control panel 80 displays a movement path, and on the other hand, the positive and negative rotation pulse signals are used for computing the dynamic mechanical loss of the system for an appropriate compensation.

In addition, the microcomputer control panel 80 is installed at a lateral side of the machine as shown in FIG. 4 to facilitate an exerciser to make an adjustment to a position. The current controller 70 is electrically connected to the microcomputer control panel 80, so that the exerciser can enter data or an instruction from the microcomputer control panel 80 to the current controller 70 for controlling the current transmitted to the motor 60 according to the signal.

A movement path sensor 54 comprises an optical interrupt disk 52 installed on the axle 41 and linked to the movement path sensor and an optical coupler 53 installed at the periphery of the optical interrupt disk 52. If the axle 41 drives the optical interrupt disk 52, and a pulse signal generated by the optical coupler 53 is transmitted to a positive and negative rotation signal decoder 74 in the current controller 70 for transmitting positive and negative rotation signals to the microcomputer control panel 80 respectively and used for controlling a curved load and providing an appropriate compensation to the load current.

Therefore, the present invention with a simple and light structure not only reduces the weight and the volume of the machine greatly, but also provides a noise-free operation and a computerized adjustment and produces continuous and smooth variable resistance, so as to achieve a comfortable use and greatly reduce the risk of exercise injuries.

In addition, an advantage derived from the computerization is the capability of the microcomputer control panel 80 to receive an exerciser heartbeat rate transmitted from a heartbeat detector. In this embodiment, the heartbeat detector comprises left and right heartbeat detection electrodes 90 installed on left and right handrails 33 of the base body 30 respectively, and the heartbeat detection method was disclosed in U.S. Pat. No. 5,337,753 entitled "Heart Rate Monitor", and thus they are prior arts and will not be described here. If both of the exerciser's hands are placed on the handrails 33, the exerciser's hands will be in contact with the left and right electrodes, so that the two electrodes will be electrically conducted by the exerciser's hands, and a voltage will be produced when blood circulates in the exerciser's body. With the principle of different heartbeat rates occurred at different frequencies of voltages, the heartbeat rate value can be measured. Therefore, the microcomputer control panel 80 will send a signal to the current controller 70 to lower the load automatically if the measured heartbeat value exceeds a safe range, so that the exerciser's heartbeat rate drops gradually to the safe range to prevent any accident caused by over-exercise.

In addition to the method of using the heartbeat detection electrode 90 for measuring heartbeats, the heartbeat detector further includes a wireless heartbeat detection element 91 such as a pulse meter or a heart rate monitor as disclosed in U.S. Pat. Nos. 4,409,983, 4,224,948, 4,120,269 and 5,807,267 can be tied to an exerciser's chest or wrist. In FIG. 9, the wireless heartbeat detection element 91 transmits an exerciser's heartbeat rate to the microcomputer control panel 80 via wireless transmissions to prevent the exerciser's heartbeat from exceeding a safe range.

In addition to the resistance, the motor 60 also produces vibrations during the loading. The exercise resistance of the present invention is provided by the motor, such that when vibrations are produced, the waveform of the vibration is a waveform selected from a sine wave, a square wave or a sawtooth wave. When the exerciser performs a leg extension exercise, the resistance, pulling force and vibration force are imposed onto the exerciser's leg, and the frequency and amplitude of the vibration can be adjusted. This is a feature that conventional weight stacks have not accomplished.

Figure 10A:
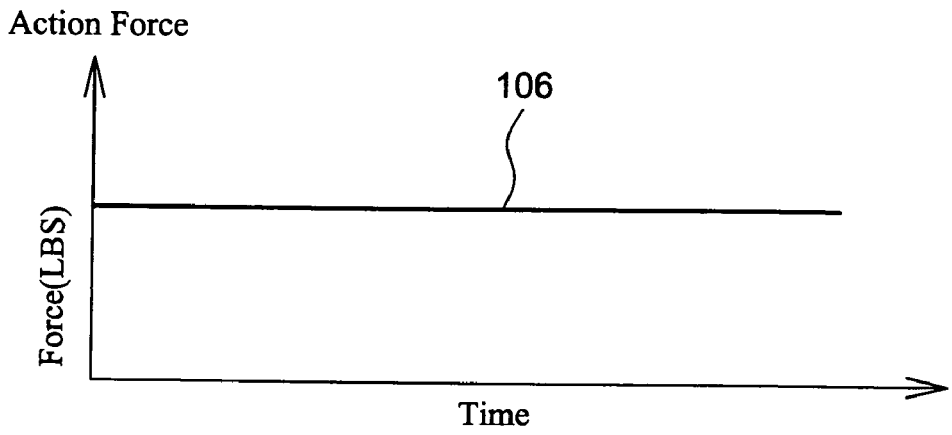
FIG.10A PRIOR ART
FIG. 10A is a graph of time versus action of a conventional extension machine.
Figure 10B:
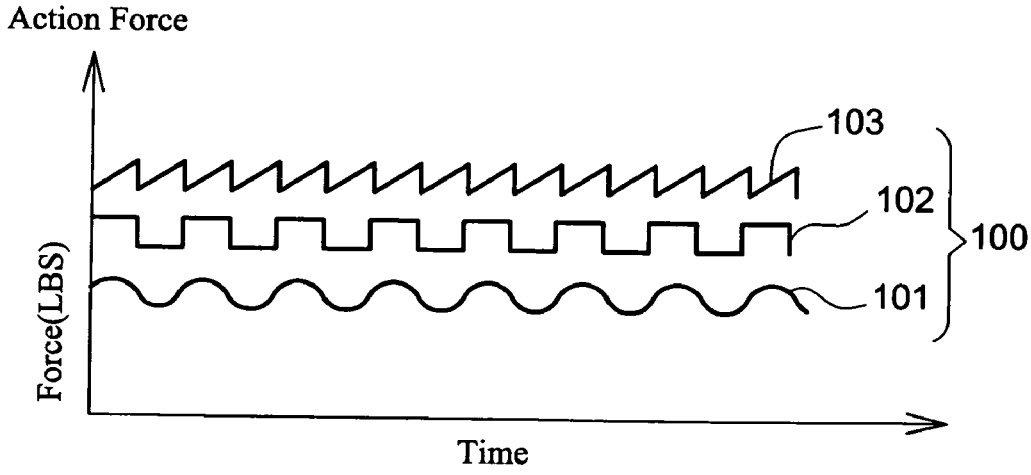
FIG. 10B is a graph of exercise time versus action of the present invention.
Figure 11A:
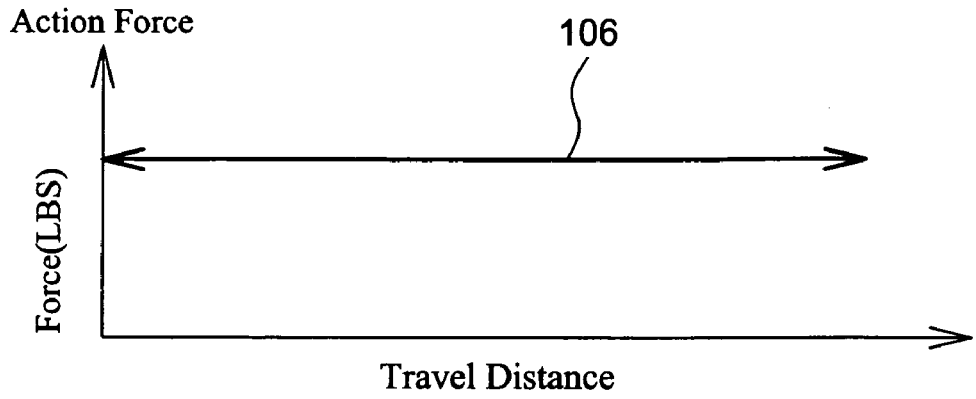
FIG.11A PRIOR ART
FIG. 11A is a graph of an exercise displacement versus action of a conventional extension machine.
Figure 11B:
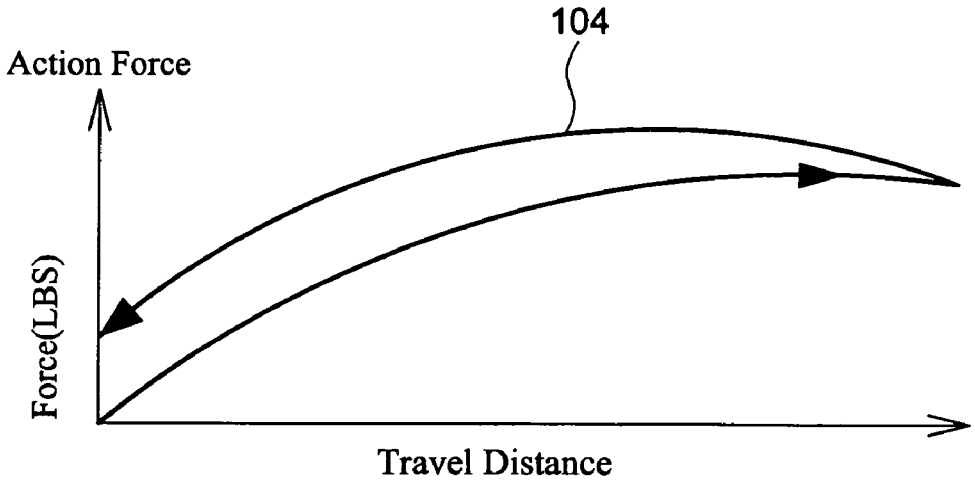
FIG. 11B is a graph of exercise displacement versus action of the present invention.

Therefore, the invention has a first unique function used for vibration training to build up muscles for users, reduce weight for women and provide therapies for the elderly. With reference to FIGS. 10A and 10B for graphs of comparing the conventional extension machine and the present invention, the vibration waveform 100 produced by the motor 60 can be set according to the exerciser's requirements, and the vibration waveform 100 is a waveform of a sine wave 101, a square wave 102 or a sawtooth wave 103, etc. This is the feature that a conventional weight extension machine has not achieved. The conventional extension machine is shown in FIG. 10A, and whose load action 106 remains unchanged.

The present invention has a second unique function of changing a pulling force and a resistance as shown by the graphs in FIGS. 10A and 10B. During an exercise, the pulling force and the resistance can be increased or decreased progressively and smoothly according to a predetermined curve 104 of the microcomputer control panel 80 to greatly reduce the risk of exercise injuries to exercisers, particularly to physical therapy patients, elderly people and women. This is what conventional weight extension machines have not accomplished.

Figure 12A:
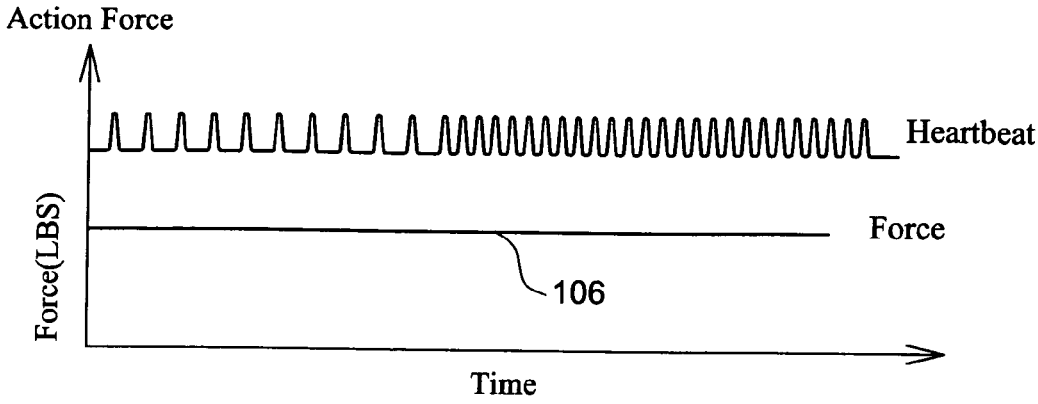
FIG.12A PRIOR ART
FIG. 12A is a graph of heartbeat rate versus action of a conventional extension machine.
Figure 12B:
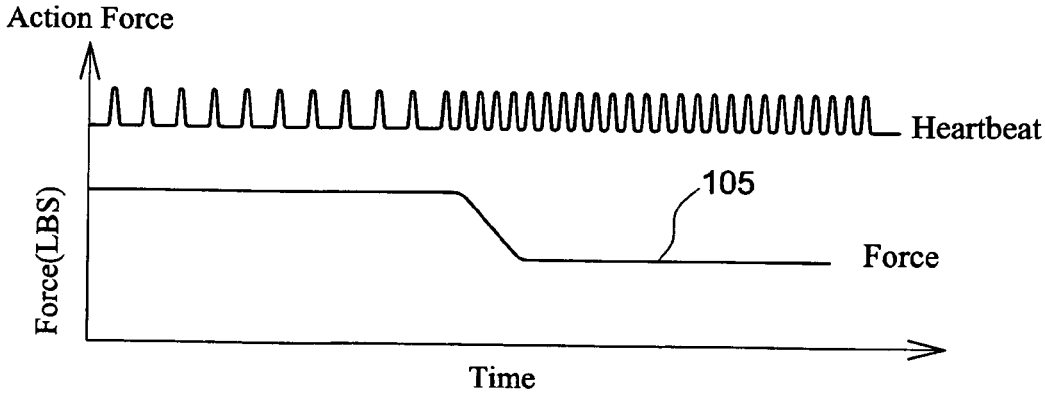
FIG. 12B is a graph of heartbeat rate versus action of the present invention

The present invention has a third unique function of controlling a load action according to an exerciser's heartbeat rate. If the exerciser's heartbeat exceeds a safe range, the microcomputer control panel 80 will lower the load action force 105 automatically as shown in FIG. 12B to reduce the heartbeat rate to the safe range gradually, or the exerciser's exercising conditions are monitored and recorded by a doctor or a trainer via a network, such that emergency can be discovered and handled timely. This is what the conventional weight extension machine cannot accomplish. With reference to FIG. 12A for a graph of heartbeat versus action, the load action 106 will remain unchanged even if the heartbeat rate exceeds the safe range, and thus the conventional extension machine may cause exercise injuries and even fatal accidents.

Figure 6:
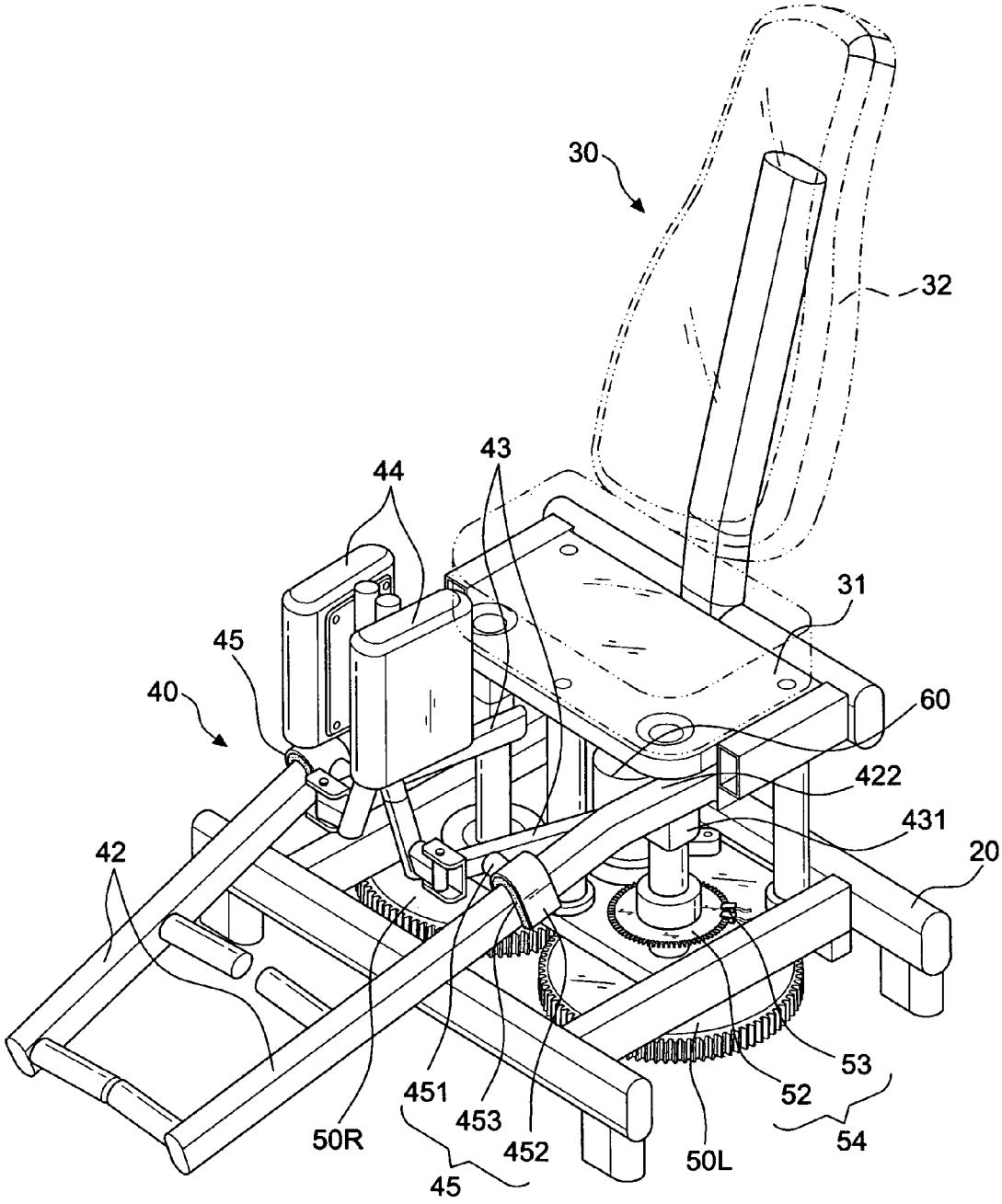
FIG. 6 is a perspective view of a second preferred embodiment of the present invention.
Figure 7:
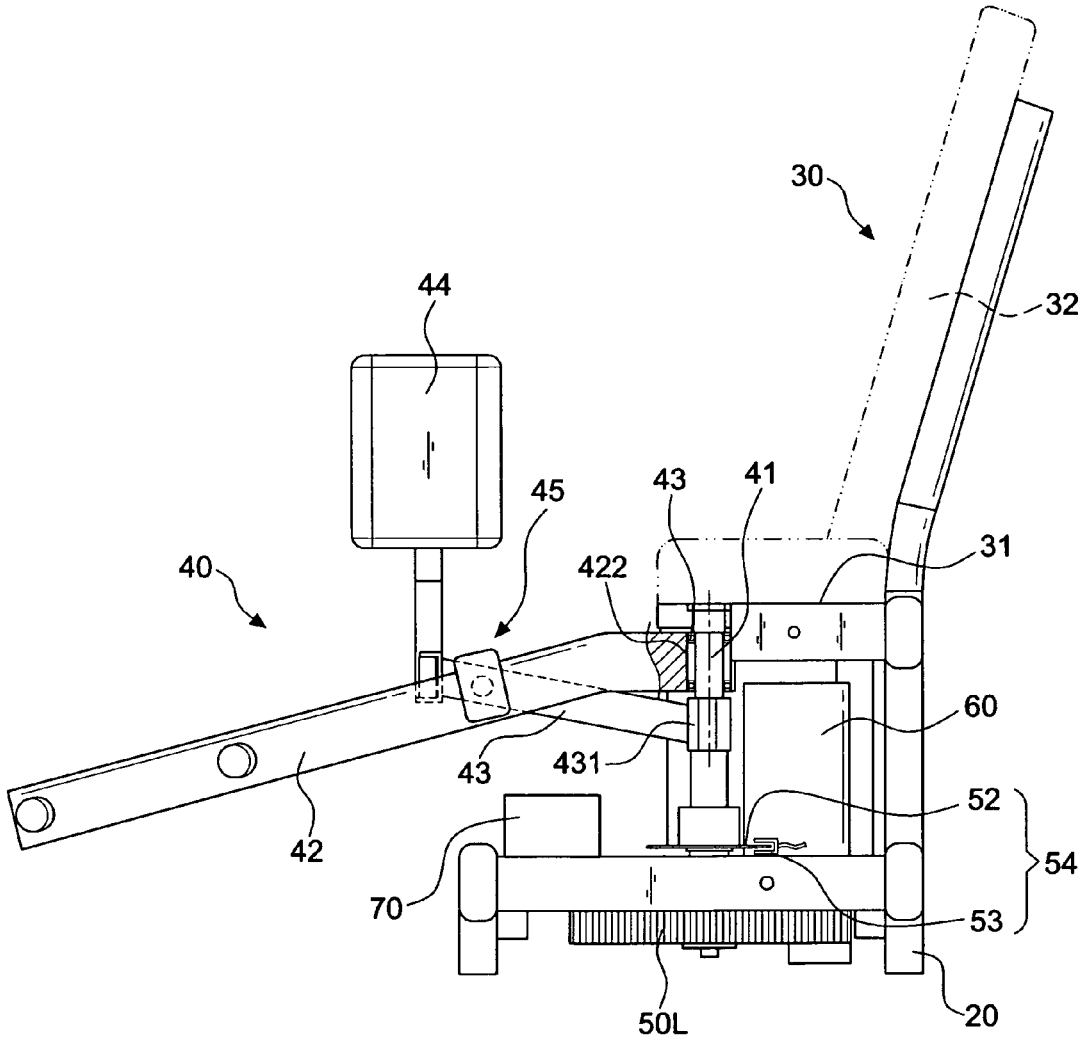
FIG. 7 is a side view of a second preferred embodiment of the present invention.
Figure 8:
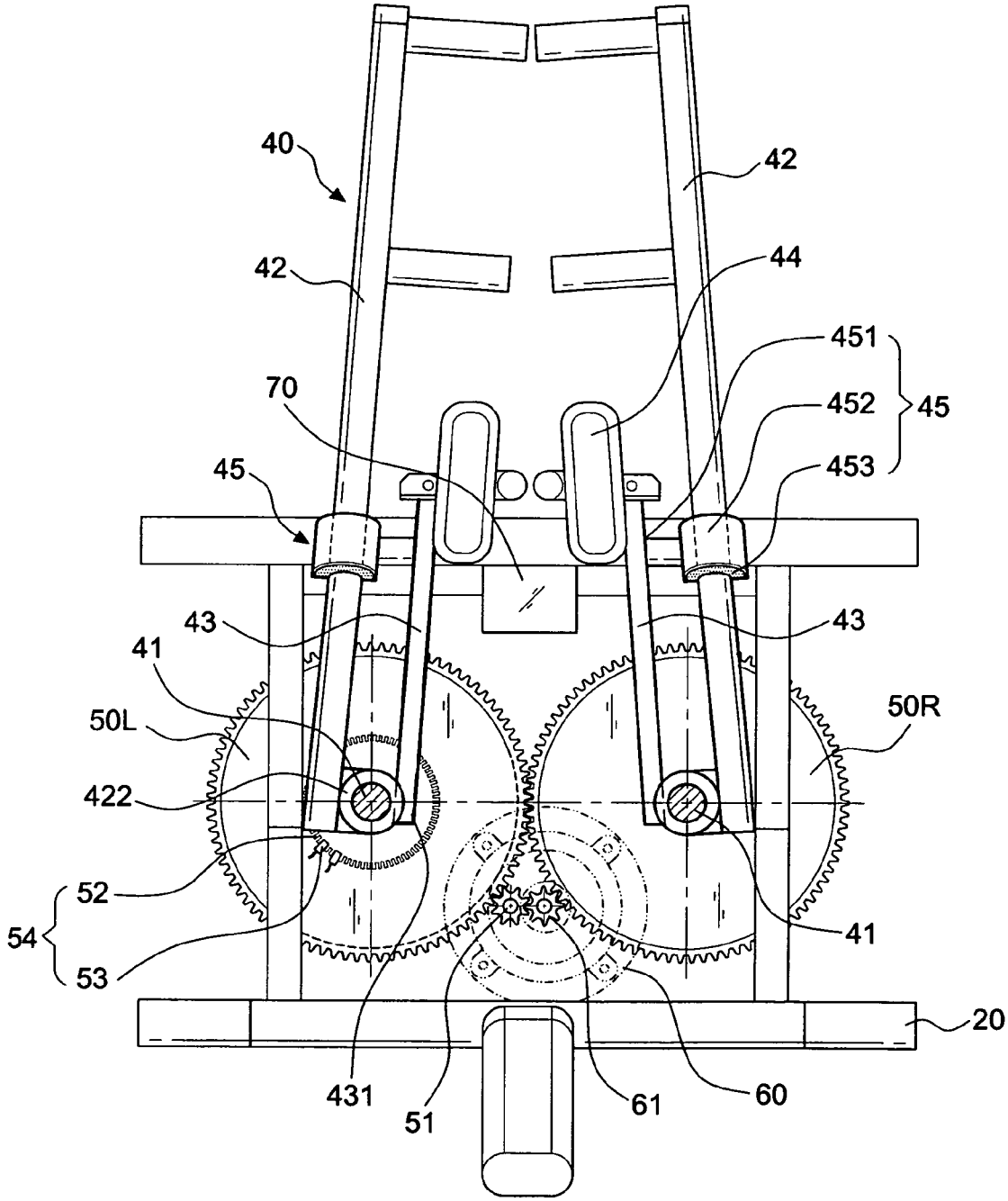
FIG. 8 is a top view of a second preferred embodiment of the present invention.

With reference to FIGS. 6 to 8 for a second preferred embodiment of the present invention, same numerals are used to represent the same structures or components of the first preferred embodiment, and the difference between the first and second preferred embodiments resides on the combining structure of the leg extension element 40. In the second preferred embodiment, an inner lateral end of the first rod 42 is pivotally coupled to the axle 41 by an axle sleeve 422, and the axle sleeve 422 includes a bearing 423, such that the first rod 42 is not linked with the axle 41, and an inner lateral end 431 of the second rod 43 is connected and fixed onto the axle 41 so as to link the axle 41; and a shock absorbing connector 45 provided for connecting the first rod 42 and the second rod 43, wherein an inner lateral end 451 of the shock absorbing connector 45 is fixed to the second rod 43, and an external end is combined onto the first rod 42 by an n-shaped body 452 and a rubber sleeve 453 to link the first and second rods 42, 43. However, the linking effect of this embodiment is slightly different from the first preferred embodiment. To cope with the vibration force produced by the axle 41, the second rod 43 of the second preferred embodiment links the first rod 42 through the shock absorbing connector 45 to provide a shock absorption effect. Therefore, the leg extension element of this preferred embodiment is more applicable to a loading device having a vibration wave. In this preferred embodiment, the current controller 70 as shown in FIGS. 7 and 8 is installed at an appropriate position of the base frame 20.

Both of the first and second preferred embodiments of the present invention adopt the left and right gear disks engaged with each other and synchronously rotated in opposite directions and also use the torque of the motor as a resistance control. If it is necessary to change an internal or external exercise, a user simply presses a key on the microcomputer control panel 80 to switch the rotating direction of the motor 60, and thus the present invention substantially improves the convenience, safety and function of using the extension machine.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A loading device of a leg extension machine, comprising:

a base frame;

a base body, disposed on the base frame, and having a seat cushion and a backrest cushion;

left and right leg extension elements, disposed symmetrically at opposite positions between the base frame and the base body, and each leg extension element including an axle pivotally coupled between the base frame and the bottom of the base body, a first rod provided for resting a foot, and a second rod disposed on an inner side of the middle of the first rod for attaching a thigh, and extended from the bottom to the top, and having a pad installed thereon; characterized in that:

the two axles of the left and right leg extension elements include a set of symmetric left and right gear disks linked and engaged with each other, such that when the leg extension elements are spread apart or pressed towards each other, the two axles drive the left and right gear disks to rotate in opposite directions synchronously;

a motor, installed on the base frame, and having a first gear installed onto a main shaft of the motor and engaged with one of the left and right gear disks, for the left and right gear disks to produce a driving resistance synchronously;

a current controller, including a DC power supply, a current and direction switching control unit, a signal processing interface, and a positive and negative rotation signal decoder, such that an exerciser can control the torque of the motor or change the rotating direction of the motor to switch inner thigh and outer thigh exercises and replace a traditional manual mechanism by adjusting a current inputted to the motor from a microcomputer control panel according to a linear relation and a direct proportion between the torque of the motor and the current; and a movement path sensor comprising an optical interrupt disk installed on and linked to the axle, and an optical coupler installed at the periphery of the optical interrupt disk, such that when the axle drives the optical interrupt disk to transmit a pulse signal generated by the optical coupler to the positive and negative rotation signal decoder in the current controller, positive and negative rotation signals are transmitted to the microcomputer control panel for controlling a curved load and compensate a load current appropriately.

2. The loading device of a leg extension machine as recited in claim 1, wherein the leg extension element includes an inner lateral end of the first rod fixed and linked to the axle, and the second rod coupled and fixed to an inner side of the first rod and driven by the first rod.

3. The loading device of a leg extension machine as recited in claim 1, wherein the leg extension element has an inner lateral end of the first rod sheathed and pivotally installed onto the axle without a link, an inner lateral end of the second rod fixed to and linked with the axle, a shock absorbing connector installed between the first rod and the second rod for coupling the first rod and the second rod, an inner lateral end of the shock absorbing connector fixed to the second rod, and another end coupled onto the first rod by an n-shaped body and a rubber sleeve, such that the second rod is driven by the first rod through the shock absorbing connector to constitute a link structure.

4. The loading device of a leg extension machine as recited in claim 1, wherein the first gear is engaged with the right gear disk, and a second gear is disposed between and engaged with the first gear and the left gear disk.

5. The loading device of a leg extension machine as recited in claim 1, wherein the microcomputer control panel receives an exerciser heartbeat rate transmitted from a heartbeat detector for controlling the torque of the motor.

6. The loading device of a leg extension machine as recited in claim 1, wherein the motor produces a vibration by a load, and the load has a vibration with a waveform selected from the collection of a sine wave, a square wave and a sawtooth wave, and both frequency and amplitude of the vibration are adjustable.

* * * * *